United States Patent [19]

Mackey

[11] 4,175,969

[45] Nov. 27, 1979

[54] ANTISTATIC PHOTOGRAPHIC X-RAY FILM HAVING A UNIFORM PROTECTIVE SURFACE COATING OF SURFACTANT OLIGOMER OF TETRAFLUOROETHYLENE

[75] Inventor: E. Scudder Mackey, Binghamton, N.Y.

[73] Assignee: GAF Corporation, New York, N.Y.

[21] Appl. No.: 887,763

[22] Filed: Mar. 17, 1978

[51] Int. Cl.[2] ..... G03C 1/38

[52] U.S. Cl. ..... 430/539; 252/500; 260/DIG. 15; 252/511

[58] Field of Search ..... 96/87 A, 87 R; 252/511, 252/500; 260/DIG. 15

[56] References Cited

U.S. PATENT DOCUMENTS

| | | | |
|---|---|---|---|
| 3,589,906 | 6/1971 | McDowell | 96/85 X |
| 3,753,716 | 8/1973 | Ishihara et al. | 96/87 A |
| 3,775,126 | 11/1973 | Babbitt et al. | 96/87 X |
| 3,779,768 | 12/1973 | Cope et al. | 96/87 R X |
| 3,850,642 | 11/1974 | Bailey et al. | 96/87 A |
| 3,884,699 | 5/1975 | Cavallo et al. | 96/87 A |

*Primary Examiner*—John D. Welsh

*Attorney, Agent, or Firm*—Walter C. Kehm; Walter Katz

[57] ABSTRACT

This invention relates to photographic elements having a coatable, non-photoactive protective surface of improved antistatic properties. The improvement is accomplished by incorporation into this layer of an anionic fluorocarbon surfactant which is characterized by being low molecular weight oligomers of tetrafluoroethylene. In a preferred embodiment of the invention, a gelatin surface protective layer of an X-ray film includes about 1.0–3.5% by weight, based on the gelatin solids of the layer, of oligomers of tetrafluoroethylene having a large amount of hydrophilic fluoroalkyl branching in the fluorocarbon chain.

2 Claims, No Drawings

ANTISTATIC PHOTOGRAPHIC X-RAY FILM HAVING A UNIFORM PROTECTIVE SURFACE COATING OF SURFACTANT OLIGOMER OF TETRAFLUOROETHYLENE

BACKGROUND OF THE INVENTION

1. Field of the Invention

This invention relates to photographic elements, and, more particularly, it is concerned with X-ray sensitive photographic elements of improved antistatic properties for use in modern rapid exposure and high speed transport medical X-ray equipment.

2. DESCRIPTION OF THE PRIOR ART

It has been known in general for a long time that the motivating, handling, winding, unwinding and the like operations, when applied to webbed materials, may encounter problems of friction, static, and the like. This is particularly true in handling photographic elements or films having one or more sensitized layers on one side of a photographic support and usually a backing layer on the opposite surface of said support. These problems are further heightened in the case of medical X-ray film by the fact that:

(1) X-ray film has two separate and independent sensitized layers on opposing surfaces of said support, and by the fact that;

(2) Recent innovations in medical X-ray processing equipment, which have been characterized by the replacement of conventional, single sheet exposing equipment with new, rapid exposure and film transport equipment, have increased processing difficulties. Such difficulties, for example, that can be caused by the new medical X-ray processing equipment, can be static discharge on the resulting element or film product, which discharge is recorded as black spots or streaks and arises as a result of rapid transport between rubber rollers or the like. Another difficulty results from jamming of the X-ray film in such equipment if the sheets do not or will not slide smoothly from the storage area to the exposure area and then to another storage area prior to processing. As examples of such new equipment presently commercially available utilizing this new technique of rapid transport exposure are those apparatus or machines marketed by Elema-Schonander (Model DST-843-2), duPont (duPont Cronex Daylight Chest Changer Model 1000), and Picker Corporation (Picker Chest Changer, Catalog No. 750-551-1).

Previous practice for resolving or at least minimizing such problems has been the application of various additive materials such as lubricating coatings, antistatic coatings, or use of other expedients such as interleaving, etc., for facilitating handling and other operations as applied to the photographic element or film.

By means of the present invention, however, improvements in conventional photographic elements or films such as color, black-and-white, and medical X-ray film, and in their conventional methods of manufacture, are now made available which permit broadened use of such photographic elements and, in particular, provide improved X-ray films for application in the new exposure-equipment now available to the art.

The prior art is represented by such U.S. Pat. Nos. as 3,933,516; 4,013,696 and Re-29,255.

Accordingly, it is an object of this invention to provide an improved photographic element which is characterized by a protective surface layer of substantially improved antistatic properties for use in modern rapid exposure and high speed transport medical X-ray equipment.

Another object of this invention is to provide such a layer which exhibits excellent coating uniformity of the surface material, when applied by multiple slide hopper metering techniques.

Still another object is to provide a gelatin based protective surface layer of an X-ray film which contains a highly branched perfluoronated fluorocarbon in a composition range which is particularly effective in reducing static defects during processing while showing good film sensitometric response.

SUMMARY OF THE INVENTION

This invention is directed to photographic elements, particularly X-ray sensitive photographic elements, of improved antistatic properties, for use in modern rapid exposure and high speed transport medical X-ray equipment. In particular, the invention concerns an improved, coatable, non-photoactive gelatin protective surface layer of X-ray film elements in to which is incorporated fluorocarbon surfactant which is characterized by being low molecular weight oligomers of tetrafluoroethylene having hydrophylic branching of fluoroalkyl groups.

In a preferred embodiment of the invention, a gelatin surface layer includes about 1.0–3.5% by weight of the gelatin solids of said oligomers of tetrafluoroethylene having the formula $(C_2F_4)_n$ where n=4, 5 or 6. Such tetrafluoroethylene oligomers are described in U.S. Pat. No. 3,758,618, and are available commercially as Monflor 31, solution, sold by ICI United States, Inc.

The improved protective surface layer is applied herein as a coating of excellent uniformity to the photographic element by multiple slide hopper techniques. Within the defined preferred concentration range, there is provided herein a static-free, high quality film elements with excellent sensitometric response.

DESCRIPTION OF THE INVENTION

What has been discovered herein is that the antistatic properties of gelatin-surface layers of X-ray radiation sensitive photographic film elements is significantly improved when these layers include ionic polymerization intermediates of tetrafluoroethylene, known as oligomers of tetrafluoroethylene, which contain a large degree of hydrophilic fluoroalkyl branching in the fluorocarbon chain. These perfluorolefins are liquids whose preparation is described in detail in U.S. Pat. No. 3,758,618, and are available commercially as Monflor 31, sold by ICI United States, Inc.

Commercial Monflor 31 is a 30% aqueous solution in isopropanol as a solvent containing a mixture of highly branched perfluoronated fluorocarbons (HBPFC), having the formula: $(C_2F_4)_n$, where n=4, 5 or 6. These include the Tetramer:

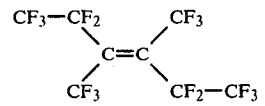

which is known chemically as cis and trans perfluoro-3,4-dimethylhex-3-ene.

The Pentamer:

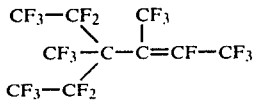

perfluoro-4-ethyl-3,4-dimethylhex-cis-2-ene;
The Hexamers: (Two Isomers)

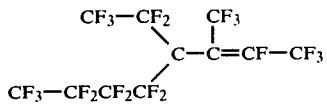

perfluoro-4-ethyl-3,4-dimethyloct-cis-2-ene; and

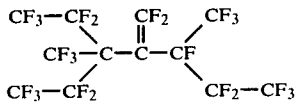

perfluoro-2-(1-ethyl-1-methylpropyl)-3-methylpent-1-ene, and other higher oligomers.

The composition of the commercial Monflor 31 product analyzes as follows:

| | Weight Percent |
|---|---|
| HBPFC (active ingredient) | 32.9 |
| Inorganic fluorine salts | 2.4 |
| 4-Hydroxybenzene sulfonate sodium salt | 11.1 |
| Isopropyl alcohol | 15.2 |
| Water | 38.4 |

A typical mixture of 112 g of the oligomers of tetrafluoroethylene (HBPFC) comprise: tetramer (13.7 g.), pentamer (63.7 g.), hexamer (22.8 g.), and heptamer, and higher oligomers (11.8 g.).

The commercial Monflor 31 coating solution then is prepared by adding the mixture of the oligomers to various solvents to form a commercial solution, generally about 30%. In the present invention, the commercial solution is diluted with water to prepare a 3% active solution of the oligomers (by volume) for a working coating solution.

In general, it is preferred that the above-mentioned composition be applied to the desired photographic element or film substrate in the form of a conventional gelatin surface-coating solution, such as one derived from acid-or or lime processed gelatin. The usual additional ingredients of a protective surface layer, such as coating aids, hardeners, etc., of course, may be added also.

The gelatin-surface coating solutions of this invention containing the oligomers of tetrafluoroethylene may be applied in conventional ways, such as from rollers, and by dipping or pouring. However, the preferred technique, as best mode of application, is described in U.S. Pat. No. 2,761,419, and is known as the multiple slide hopper metering technique. Alternatively, the common bead coating technique may be employed. Using these methods, the coating uniformity of the surface layer which is obtained is excellent indeed. The coatings are characterized particularly by a lack of voids across the surface of the layer.

For a further understanding and greater appreciation of the present invention, reference may be had to the following examples which are set forth for illustrating certain of the preferred embodiments thereof. All percentage values are by weight unless stated otherwise.

EXAMPLE 1

A conventional silver halide, medical X-ray emulsion in gelatin containing 4% silver iodide and 96% silver bromide was prepared in a conventional manner known to the art. It was then readied for coating on film base. A 5% surface gelatin solution in water was prepared, and coating finals or aids such as spreading agents, stabilizers, hardeners, and pH adjustment agents were added. Six equal aliquot samples of the resulting surface gelatin solution were then taken, one of these, to which nothing else was added, acting as a control. To each of the remaining five samples, variations in compositions of Monflor 31 (as defined hereinabove), based on the total gelatin solids content present, was added, ranging from 0.6 to 6%. The coatings were applied uniformly via the multiple slide hopper metering technique described in U.S. Pat. No. 2,761,419. The coatings were slit to the proper size for the Schonander Medical X-ray exposure equipment. Several sheets of each of the six coatings then were exposed in the unit. The films then were processed and examined for diagnostic quality, particularly for the static defect.

The results showed that all the control blank sheets had objectionable static marks. At concentrations of about 1 to about 3.5% by weight of gelatin of Monflor 31 solution, however, the sheets were completely free of static and had excellent sensitometric response. A concentration of 1.5% was considered more nearly optimum as a working composition.

EXAMPLE 2

A typical formulation of a working solution for coating x-ray surfaces was prepared as follows:

| | |
|---|---|
| Monflor 31 (3% active by volume) | 600cc |
| Gelatin | 1 Kg. |
| Water | 25 l |
| Brij 30 (ICI) Tergitol 4 (Union Carbide)$H_2O$ (3.3:5.8:0.9 by vol.) surfactant | 40 cc |
| Surfynol 440 (AirCo) (10% by vol.), a surfactant sensitizer | 80 cc |
| Pluracol 450 (BASF) (27% by vol.) sensitizer | 2.5 l |
| Formaldehyde | 360 cc |
| Sodium hydroxide (3N) | to pH 6.7-6.9 |

The above solution was applied as in Example 1 to the x-ray emulsion to provide excellent antistatic properties to the medical x-ray film.

While this invention has been described with regard to certain embodiments thereof, it will be appreciated that various changes and variations may be made which are within the purview of the invention and within the skill of the art. Accordingly, it is intended to be bound only by the appended claims.

What is claimed is:

1. An X-ray sensitive photographic element having an antistatic and protective layer thereon which is a uniform, coatable, non-photoactive gelatin-containing composition exhibiting an excellent sensitometric response comprising about 1 to about 3.5% by weight, based upon the gelatin content of said composition, of a fluorocarbon surfactant which is a mixture of low molecular weight oligomers of tetrafluoroethylene having hydrophilic fluorocarbon branching in the fluorocarbon chain, wherein said oligomers have the formula $(C_2F_4)_n$, where n is 4, 5 or 6, and comprise primarily the pentamer oligomer.

2. A composition according to claim 1 wherein said oligomers constitute about 1.5% by weight of the gelatin solids.

* * * * *